US011268217B2

(12) United States Patent
Woodruff et al.

(10) Patent No.: US 11,268,217 B2
(45) Date of Patent: Mar. 8, 2022

(54) WRAPPABLE END FRAY RESISTANT WOVEN PROTECTIVE TEXTILE SLEEVE AND METHOD OF CONSTRUCTION THEREOF

(71) Applicant: Federal-Mogul Powertrain, Inc., Southfield, MI (US)

(72) Inventors: Alexa A. Woodruff, Bryn Mawr, PA (US); Michael D. Knudson, Mohnton, PA (US); Tianqi Gao, Exton, PA (US); Cassie M. Malloy, Trappe, PA (US)

(73) Assignee: Federal-Mogul Powertrain LLC, Southfield, MI (US)

( * ) Notice: Subject to any disclaimer, the term of this patent is extended or adjusted under 35 U.S.C. 154(b) by 703 days.

(21) Appl. No.: 14/975,129

(22) Filed: Dec. 18, 2015

(65) Prior Publication Data

US 2017/0175304 A1 Jun. 22, 2017

(51) Int. Cl.
*D03D 1/00* (2006.01)
*D03D 3/02* (2006.01)
(Continued)

(52) U.S. Cl.
CPC ..... *D03D 1/0043* (2021.05); *D03D 3/02* (2013.01); *D03D 15/00* (2013.01); *H01B 7/0045* (2013.01);
(Continued)

(58) Field of Classification Search
CPC ..... D03D 1/0035; D03D 3/02; D03D 15/00; H01B 7/0045; H01B 7/185; D10B 2401/041
(Continued)

(56) References Cited

U.S. PATENT DOCUMENTS 2,864,151 A * 12/1958 Bihaly ..... D06M 17/00 442/187
5,178,630 A 1/1993 Schmitt
(Continued)

FOREIGN PATENT DOCUMENTS

EP 1371762 12/2003
JP H0881851 A 3/1996
(Continued)

OTHER PUBLICATIONS

International Search Report, dated Mar. 28, 2017 (PCT/US2016/065737).

*Primary Examiner* — Michael C Miggins
(74) *Attorney, Agent, or Firm* — Robert L. Stearns; Dickinson Wright, PLLC

(57) ABSTRACT

An end fray resistant textile sleeve includes an elongate wall having warp yarns extending generally parallel to a longitudinal central axis of the sleeve and fill yarns extending circumferentially about the sleeve. The warp yarns include at least two different types of yarns, with one of the types of warp yarns including activateable yarns and another of the types of yarns including non-activateable yarns. The activateable yarns can be provided as being activateable by at least one of heat, fluid and/or pressure, such that upon being activated, the yarns are caused to bond with the adjacent non-activateable warp yarns, as well as with the weft yarns with which they make contact. As such, the activateable yarns, upon being activated, become fixed with abutting warp yarns and weft yarns, thereby inhibiting end fray from resulting during a subsequent cold-cutting operation as well as in use.

9 Claims, 3 Drawing Sheets

(51) Int. Cl.
*H01B 7/00* (2006.01)
*H01B 7/18* (2006.01)
*D03D 15/00* (2021.01)

(52) U.S. Cl.
CPC ..... *H01B 7/185* (2013.01); *D10B 2401/041* (2013.01)

(58) Field of Classification Search
USPC ..... 385/102; 138/123; 428/35.1, 36.1, 36.3
See application file for complete search history.

(56) References Cited

U.S. PATENT DOCUMENTS 5,413,149 A * 5/1995 Ford ..... D03D 3/02 138/103
5,866,216 A 2/1999 Flasher
6,003,565 A * 12/1999 Whittier, II ..... D03D 15/00 139/420 A
6,227,094 B1 5/2001 Taylor et al.
7,288,494 B2 10/2007 Iwasaki et al.
2005/0124249 A1 6/2005 Uribarri
2007/0166495 A1 7/2007 Sellis et al.
2010/0313989 A1 12/2010 Kashihara
2011/0083879 A1 4/2011 Avula et al.
2011/0236614 A1 9/2011 Ushikai et al.
2013/0228248 A1 9/2013 Malloy et al.
2013/0243985 A1 9/2013 Furuta et al.
2014/0272218 A1* 9/2014 Thomas ..... D02G 3/38 428/35.1
2015/0337465 A1 11/2015 Woodruff et al.

FOREIGN PATENT DOCUMENTS

JP 2012529578 A 11/2012
JP 2016516912 A 6/2016
JP 2017515993 A 6/2017
KR 20150129018 A 11/2015
KR 20170007746 A 1/2017
WO 2014034799 A1 3/2014

* cited by examiner

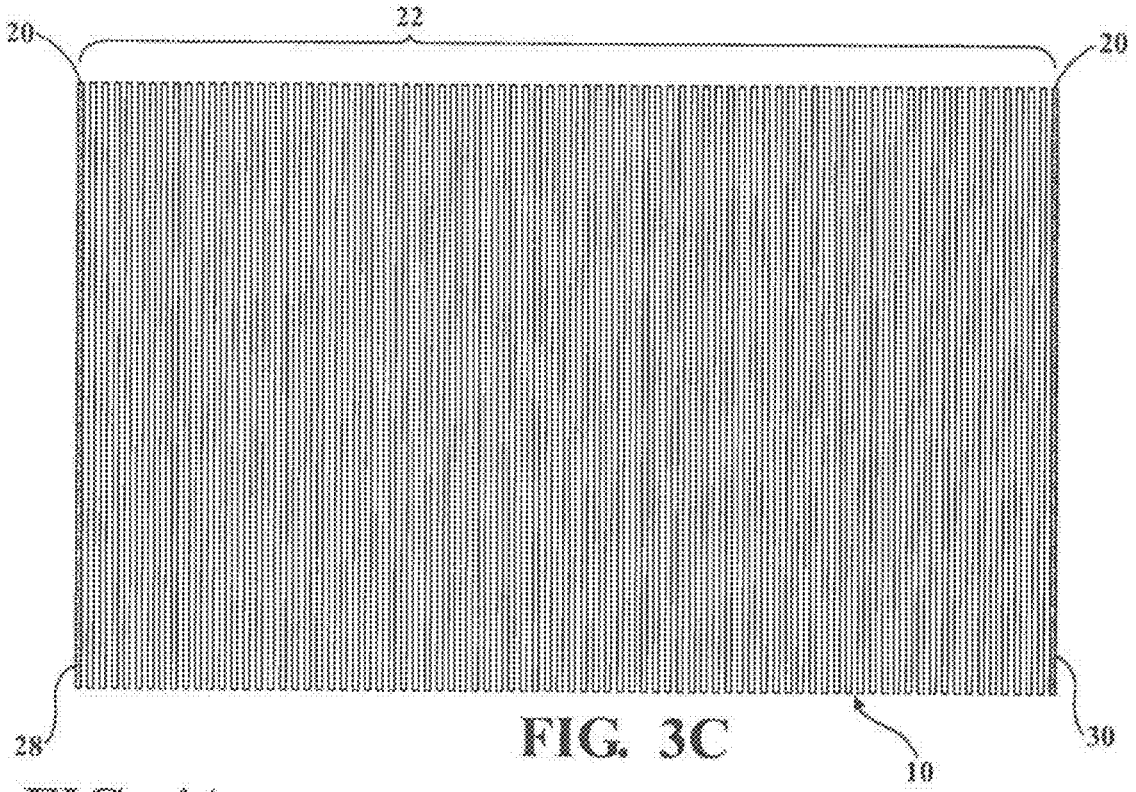
FIG. 3C
FIG. 4A
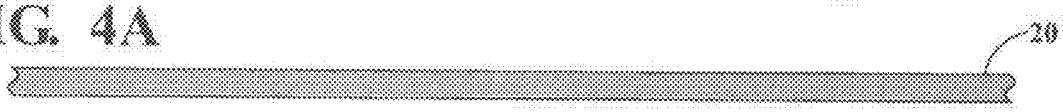
FIG. 4B
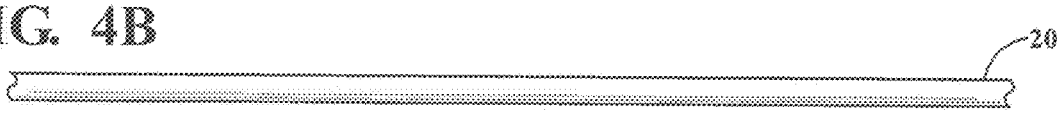
FIG. 4C
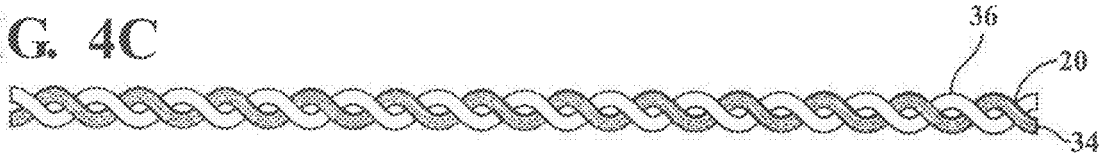
FIG. 4D
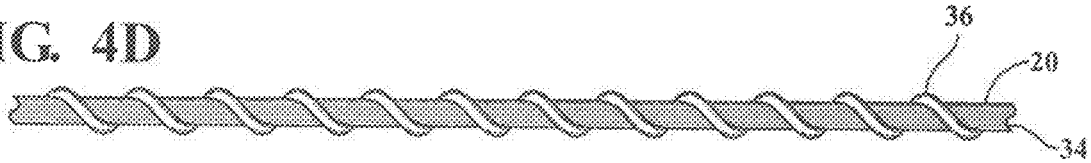
FIG. 4E
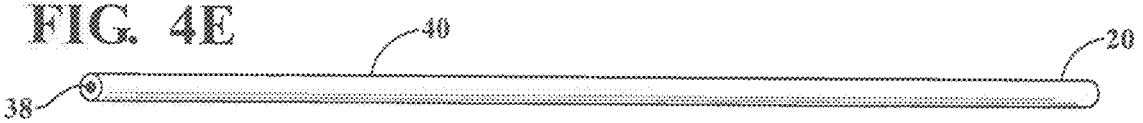

WRAPPABLE END FRAY RESISTANT WOVEN PROTECTIVE TEXTILE SLEEVE AND METHOD OF CONSTRUCTION THEREOF

BACKGROUND OF THE INVENTION

1. Technical Field

This invention relates generally to protective sleeves for elongate members, and more particularly to woven textile sleeves.

2. Related Art

Elongate members, such as wires or wire harnesses, are commonly protected against abrasion and contamination by wrappable textile sleeves. It is known to construct wrappable textile sleeves from woven yarns. In order to form the desired sleeve length, and to avoid fraying the ends of the sleeve, it is known to use lasers, ultrasonic cutting devices, and the like, which melt the material of the sleeve wall during the cutting process, thereby reducing the likelihood of causing the material of the sleeve wall to fray. In addition, it is known to apply a chemical coating agent to the sleeve wall after forming the sleeve wall and prior to cutting the sleeve wall to reduce the likelihood of fraying the material of the sleeve wall during the cutting process. Although the aforementioned mechanisms can be effective in reducing the likelihood of fraying the material of the sleeve wall, they require specialized cutting devices or processes, and thus, they come at an added cost.

SUMMARY OF THE INVENTION

An end fray resistant textile sleeve for protecting elongate members is provided. The sleeve includes an elongate wall having warp yarns extending generally parallel to a longitudinal central axis of the sleeve and fill yarns extending circumferentially about the sleeve. The warp yarns and the fill yarns are woven in an overlying and underlying weave pattern with one another. The warp yarns include at least two different types of yarns, with one of the types of warp yarns including activateable yarns and another of the types of yarns including non-activateable yarns. The activateable yarns can be provided as being activateable by at least one of heat, fluid and/or pressure, such that upon being activated, the yarns are caused to bond with the adjacent non-activateable yarns, as well as with the weft yarns with which they make contact. As such, the activateable yarns, upon being activated, become fixed with the aforementioned non-activateable warp yarns and weft yarns, thereby inhibiting end fray from resulting during a subsequent cold-cutting operation that is performed to cut the sleeve to length as well as in use.

In accordance with another aspect of the invention, the activateable yarns can be provided as monofilaments and/or multifilaments.

In accordance with another aspect of the invention, the activateable yarns can be provided as monofilaments and/or multifilaments of non-activateable material coated with an activateable material.

In accordance with another aspect of the invention, the activateable yarns can be provided as bicomponent monofilaments having a central core of a material having a first melt temperature and an outer sheath of a material having a second melt temperature, wherein the first melt temperature is higher than the second melt temperature.

In accordance with another aspect of the invention, the activateable yarns can be provided as entangled yarns including non-activateable material entangled with activateable material.

In accordance with another aspect of the invention, the activateable yarns can be provided as a non-activateable monofilament or multifilament yarn twisted or served with an activateable monofilament or multifilament yarn.

In accordance with another aspect of the invention, the overlying and underlying weave pattern is formed as one of a plain, rib, basket or twill weave pattern.

In accordance with another aspect of the invention, the fill yarns can be provided at least in part as multifilaments to provide the wall with enhanced protection coverage.

In accordance with another aspect of the invention, the wall can be formed as a wrappable wall having opposite edges extending generally parallel to the central longitudinal axis wherein the opposite edges are brought into overlapping relation with one another.

In accordance with another aspect of the invention, the fill yarns can be provided at least in part as heat-set yarns to bias the opposite edges into overlapping relation with one another.

In accordance with another aspect of the invention, the wall can be formed as a seamless, circumferentially continuous wall.

In accordance with another aspect of the invention, a method of constructing an end fray resistant textile sleeve for protecting elongate members is provided. The method includes forming an elongate wall by weaving warp yarns and fill yarns with one another in an overlying and underlying weave pattern. The method further includes providing the warp yarns including at least two different types of yarns, with one of the types of warp yarns being activateable yarns and another of the types of yarns including non-activateable yarns. The method further includes activating the activateable yarns via application of at least one of heat, fluid and/or pressure, such that upon being activated, the activated yarns are caused to bond with the adjacent non-activateable yarns, as well as with the weft yarns with which they make contact. As such, the activated warp yarns become fixed with the aforementioned non-activateable warp yarns and weft yarns, thereby inhibiting weft yarns falling out opposite ends of the sleeve during a subsequent cold-cutting operation that is performed to cut the sleeve to length as well as in use.

In accordance with another aspect of the invention, the method can further include providing the activateable warp yarns as monofilaments and/or multifilaments.

In accordance with another aspect of the invention, the method can further include providing the activateable warp yarns as monofilaments of non-activateable material coated with an activateable material and/or multifilaments of non-activateable material coated with an activateable material.

In accordance with another aspect of the invention, the method can further include providing the activateable warp yarns as bicomponent monofilaments having a central core of a material having a first melt temperature and an outer sheath of a material having a second melt temperature, wherein the first melt temperature is higher than the second melt temperature.

In accordance with another aspect of the invention, the method can further include providing the activateable warp yarns as entangled yarns including non-activateable material entangled with activateable material.

In accordance with another aspect of the invention, the method can further include providing the activateable warp yarns as a non-activateable monofilament or multifilament yarn twisted or served with an activateable monofilament or multifilament yarn.

In accordance with another aspect of the invention, the method can further include forming the weave pattern as one of a plain, rib, basket or twill weave pattern.

In accordance with another aspect of the invention, the method can further include providing the fill yarns at least in part as multifilaments to provide the wall with enhanced protection coverage.

In accordance with another aspect of the invention, the method can further include forming the wall as a wrappable wall having opposite edges extending generally parallel to the central longitudinal axis and bringing the opposite edges into overlapping relation with one another.

In accordance with another aspect of the invention, the method can further include heat-setting at least some of the fill yarns to bias the opposite edges into overlapping relation with one another.

In accordance with another aspect of the invention, the method can further include forming the wall as a seamless, circumferentially continuous wall.

BRIEF DESCRIPTION OF THE DRAWINGS

These and other aspects, features and advantages of the invention will become readily apparent when considered in connection with the following detailed description of presently preferred embodiments and best mode, appended claims and accompanying drawings, in which:

FIGS. 3A-3C are schematic plan views illustrating different walls of the sleeves of FIGS. 1A and 1B in accordance with different aspects of the invention; and FIGS. 4A-4E are schematic plan views illustrating different activateable warp yarns of the sleeves of FIGS. 1A and 1B in accordance with different aspects of the invention.

DETAILED DESCRIPTION OF PRESENTLY PREFERRED EMBODIMENTS

Figure 1A:
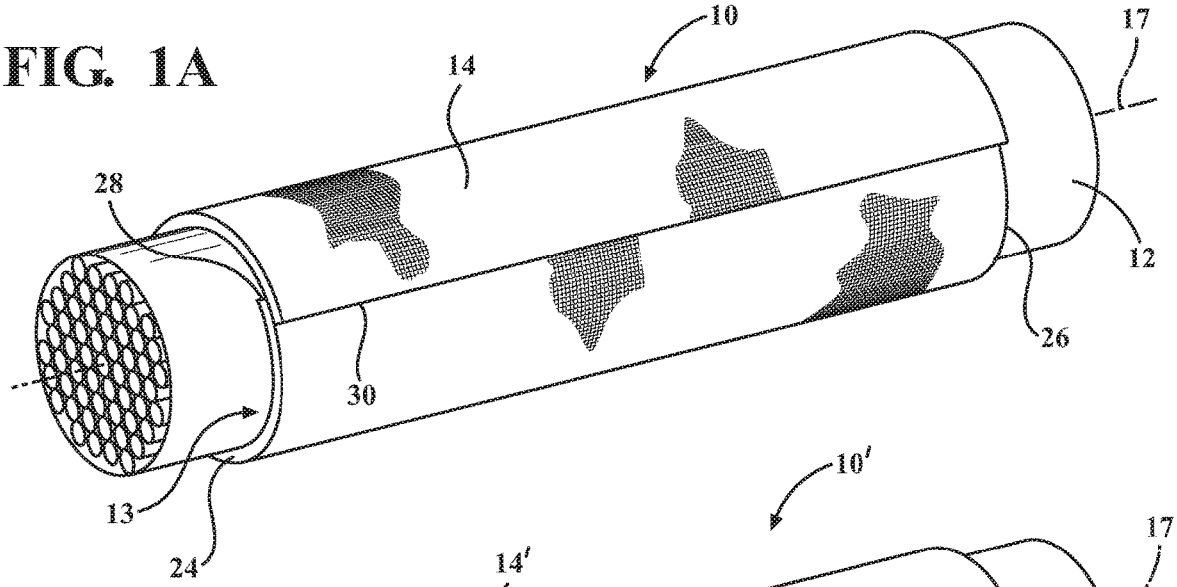
FIG. 1A is a schematic perspective view of a protective sleeve constructed in accordance with one presently preferred embodiment shown protecting an elongate member.
Figure 1B:
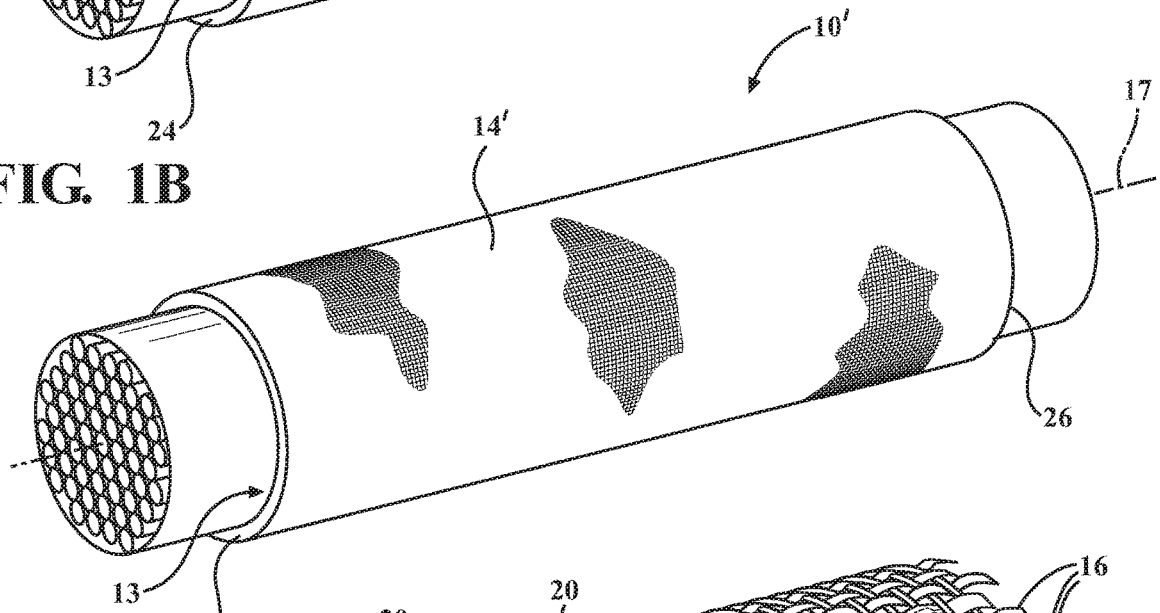
FIG. 1B is a schematic perspective view of a protective sleeve constructed in accordance with another presently preferred embodiment shown protecting an elongate member.

Referring in more detail to the drawings, FIGS. 1A and 1B illustrate a end fray resistant textile sleeves, with the sleeve 10 of FIG. 1A being an "open" sleeve and the sleeve 10' being a "closed" sleeve, discussed in more detail hereafter, wherein the same reference numerals are used to identify like features for both sleeves 10, 10'. The sleeves 10, 10' will be referred to hereafter as sleeve, in singular fashion, though it will be made clear by the use of unprimed and primed reference numerals that both sleeves 10, 10' are being discussed. This said, it is to be recognized that all discussion hereafter applies to both sleeves 10, 10', unless expressly stated otherwise. The sleeve 10, 10' is particularly useful for protecting an elongate member 12 disposed in a cavity 13 of the sleeve 10, 10', such as conduits or wire harnesses, by way of example and without limitation. The sleeve 10, 10' has an elongate wall 14, 14' having warp yarns 16 extending generally parallel to a longitudinal central axis 17 of the sleeve 10, 10' and weft, also referred to as fill yarns 18 extending transversely to the warp yarns 16 and circumferentially about the wall 14, 14'. The warp yarns 16 and fill yarns 18 are woven with one another in an overlying and underlying desired weave pattern, such that they undulate over and under one another, such as in a plain, rib, basket or twill weave pattern, for example. The warp yarns 16 include at least two different types of yarns, with one of the types of warp yarns including activateable yarns 20 and another of the types of yarns including non-activateable yarns 22. The activateable yarns 20 can be provided as being activateable by at least one of heat, fluid and/or pressure, such that upon being activated, the yarns 20 are caused to bond with the adjacent non-activateable warp yarns 22, as well as with the weft yarns 18 with which they make contact. As such, the activateable yarns, upon being activated, become fixed with the aforementioned non-activateable warp yarns 22 and weft yarns 18, thereby inhibiting end fray from resulting during a subsequent cold-cutting operation that is performed to cut the sleeve 10 to length as well as in use.

The sleeve 10, 10' extends lengthwise along the longitudinal central axis 17 between opposite ends 24, 26. The sleeve 10, as indicated above, is "open", and thus, it has a lengthwise seam formed between opposite sides 28, 30 that extend generally parallel to the longitudinal central axis 17 between the opposite ends 24, 26. The weft yarns 18 of the wall 14 can be provided, at least in part, as heat-settable yarns, such as mostly or entirely as monofilaments or multifilaments of a heat-formable material, such as poly (ethylene) terephthalate (PET) or poly(phenylene) sulfide (PPS), by way of example and without limitation, wherein the heat-settable weft yarns 18 can be heat-set to bias the opposite sides 28, 30 into overlapping relation with one another. In use, during installation, the opposite sides 28, 30 can be readily spread apart from one another to facilitate installing the elongate member 12 therein, and then the sides 28, 30 can be released to allow the sides 28, 30 to automatically return to their overlapping relation, thus, providing protection about the entire circumference of the elongate member 12. In addition to the heat-settable weft yarns, it should be recognized that non-heat-settable weft yarns 18 can also be incorporated in the wall 14 of the sleeve 10, as desired for the intended application.

The sleeve 10', as indicated above, is "closed", and thus, it has a circumferentially continuous, seamless wall 14' extending about the cavity 13 between the opposite ends 24, 26. It should be recognized that the weft yarns 18 of the wall 14' can be provided as discussed above for the wall 14, thereby allowing the wall 14' to be heat-set to facilitate maintaining a generally round configuration of the cavity 13. Other than being closed, the sleeve 10' and its material content can be the same as that for the open sleeve 10.

Figure 2:
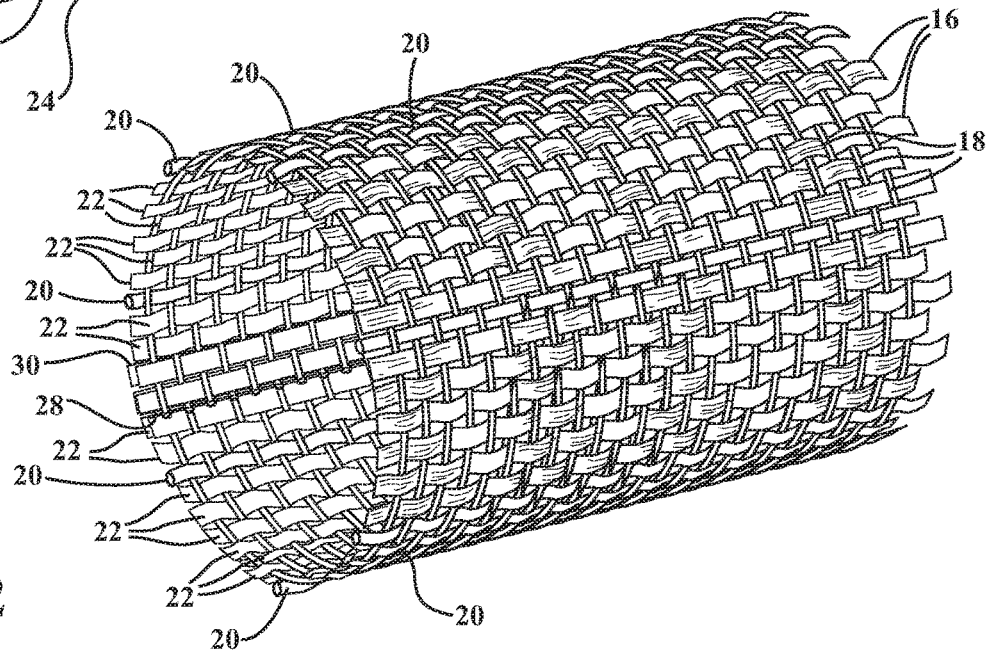
FIG. 2 is an enlarged partial plan view of a wall of the sleeves of FIGS. 1A and 1B constructed in accordance with one aspect of the invention.

As evidenced in the various embodiments illustrated in the drawings, the activatable warp yarns 20 can be woven in different ways to provide the sleeve 10, 10' with the physical attributes desired. For example, as shown in FIG. 2, wherein a portion of an open wall 14 of the sleeve 10 is illustrated, the activatable warp yarns 20 are shown as being woven as individual, single yarns in circumferentially spaced relation from one another. The individual activable warp yarns 20 are spaced circumferentially from one another by intervening non-activateable warp yarns 22. In the embodiment shown, the wall 14 has a ratio of activateable to non-activateable warp yarns of about 1:6. It should be recognized that this pattern and ratio is equally applicable to the wall 14' of the sleeve 10'. Upon being woven, the activateable warp yarns 20 are activated, such as via heat, pressure and/or fluid, thereby causing the activated warp yarns 20 to bond with the adjacent, abutting non-activatable warp yarns 22 as well as with the weft yarns 18. As such, during a subsequent cutting operation, such as a cold cutting operation, the weft yarns 18 adjacent the ends 24, 26 of the cut sleeve 10, 10' are inhibited from unraveling and fraying due to being bonded with the activated warp yarns 20.

Figure 3A:
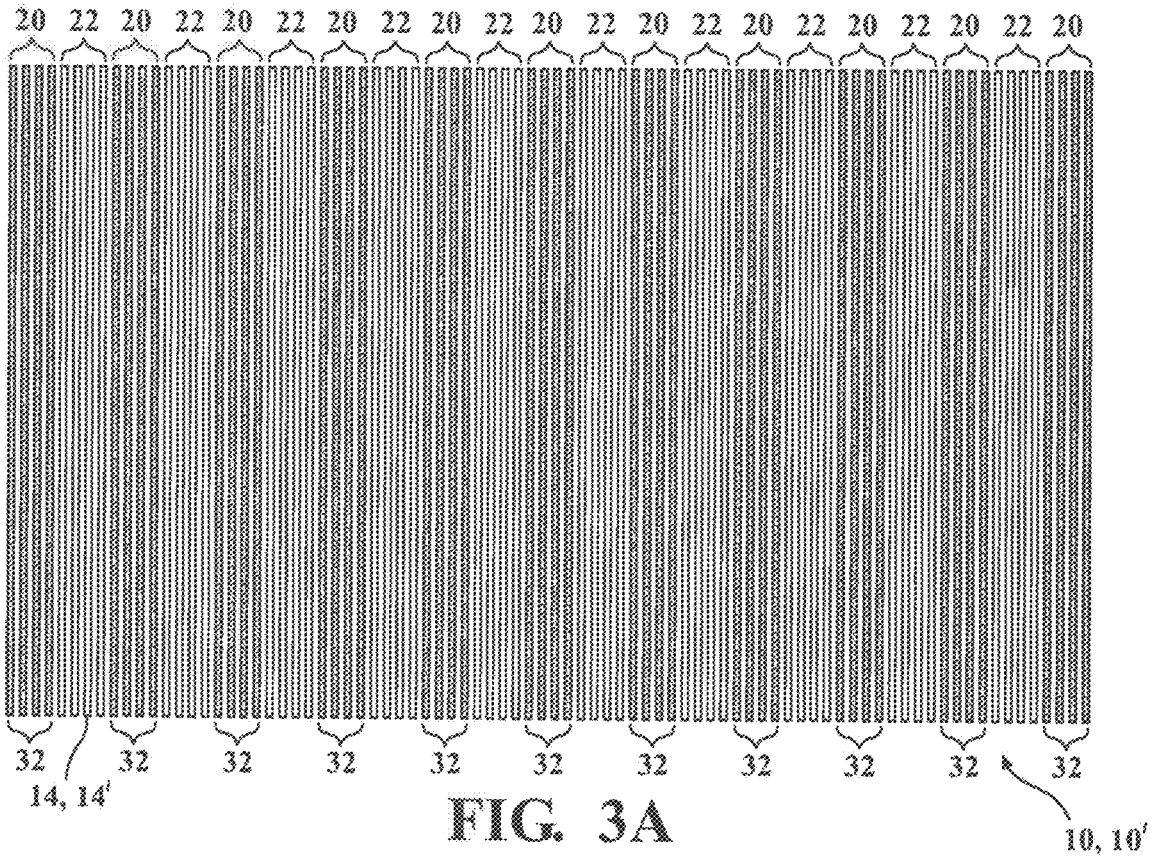
Figure 3B:
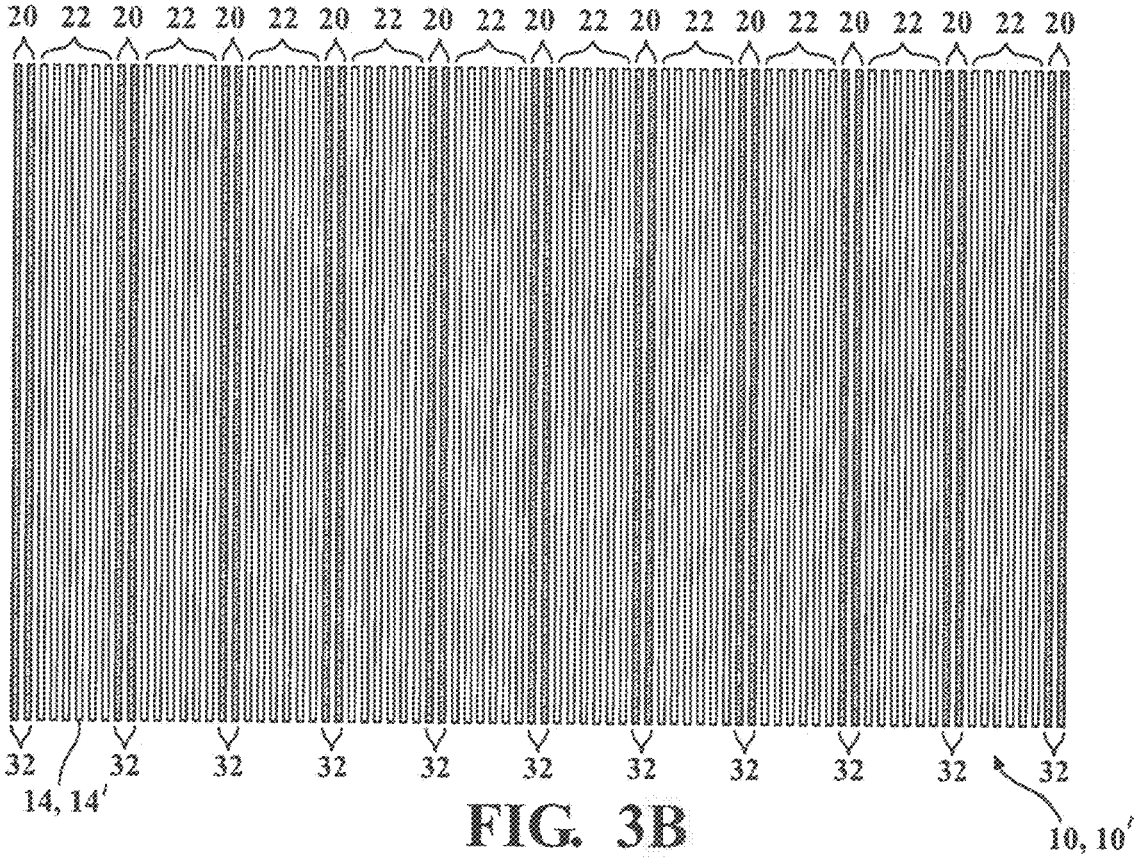

In FIGS. 3A-3C, further embodiments illustrating plan views of different weave patters of the activateable warp yarns are shown, with it being understood that the patterns of FIGS. 3A and 3B are schematic plan view representations for both open and closed sleeves 10, 10', while FIG. 3C is a schematic plan view representation of a minimum location of activateable warp yarn 20 for the open sleeve 10 along its opposites sides 28, 30. In FIG. 3A, a relatively increased presence of the activateable warp yarn 20 relative to the non-activateable warp yarn 22 is shown for the sleeve 10, 10'. The ratio of activateable warp yarn 20 to the non-activateable warp yarn 22 is shown as being about 1:1. In the embodiment illustrated, the activateable warp yarn 20 is shown as being arranged in a plurality of bundles 32. Each bundle 32 includes a plurality of activated warp yarns 20, shown by way of example and without limitation as being four, arranged in side-by-side abutting relation with one another, with each bundle 32 being spaced circumferentially from one another by a plurality of the non-activateable warp yarns 22, shown by way of example and without limitation as being four. It should be recognized, that although not shown for simplicity, that weft yarns 18 are woven with the warp yarns 16, wherein the individual warp and weft yarns 16, 18 can be woven via any suitable weave pattern, such as a plain weave pattern, by way of example and without limitation, wherein abutting ones of the activated warp yarns 20 within the bundles 32 undulate over and under the weft yarns 18 out of phase with one another.

In FIG. 3B, a lesser presence of the activateable warp yarn 20 relative to the non-activateable warp yarn 22 is shown for the sleeve 10, 10' relative to the sleeve of FIG. 3A. The ratio of activateable warp yarn 20 to the non-activateable warp yarn 22 is shown as being about 1:3. In the embodiment illustrated, the activateable warp yarn 20 is shown as being arranged in a plurality of bundles 32, similar to the bundles 32 shown in FIG. 3A; however, each bundle 32 only includes two activated warp yarns 20 arranged in side-by-side abutting relation with one another. Otherwise, the construction shown in FIG. 3B is similar to that discussed for FIG. 3A, wherein each bundle 32 is spaced circumferentially from one another by a plurality of the non-activateable warp yarns 22, shown by way of example and without limitation as being 6.

In FIG. 3C, a minimized presence of the activateable warp yarn 20 relative to the non-activateable warp yarn 22 is shown for the open sleeve 10. In the embodiment shown, bundles 32 of activateable warp yarns 20 are present only along the opposite sides 28, 30, wherein the bundles 32 can be formed having any desired number of activateable warp yarns 20. It is contemplated that the activateable warp yarns 20 could be provided a single yarns along each side 28, 30; however, this would provide a minimum amount of protection against end fray. The warp yarns 16 extending between the pair of bundles 32 are provided as non-activateable warp yarns 22.

In FIGS. 4A-4E, a variety of different types of activateable warp yarns 20 are shown, wherein one or more of the different types of the activateable warp yarns 20 can be used in a single sleeve 10, 10'. In FIG. 4A, the activateable warp yarn 20 is shown as a multifilament yarn, wherein the multifilament includes at least some, or entirely heat-activateable, pressure activateable or fluid activateable material extending along its length. The multifilament can be formed of separate filaments intertwined with one another, or as an entangled member including activateable material entangled with non-activateable material, such as fibrous materials entangled with one another. In FIG. 4B, the activateable warp yarn 20 is shown as a monofilament, wherein the monofilament is comprised of heat-activateable, pressure activateable or fluid activateable material, such that upon being exposed to the appropriate heat, pressure or fluid source, the activateable warp yarn 20 becomes activated and bonds with the neighboring, abutting warp and weft yarns 16, 18. In FIG. 4C, the activateable warp yarn 20 is shown as a combination of yarns intertwined with one another, wherein the different yarns are shown as being twisted with one another, while in FIG. 4D the different yarns are shown as being served with one another. The different yarns combined with one another to form the activateable warp yarn 20 can include a non-activateable monofilament or multifilament yarn 34 twisted or served with an activateable monofilament or multifilament yarn 36. In FIG. 4E, the activateable warp yarn 20 is shown as a bi-component monofilament, wherein the bicomponent monofilament includes a central core 38 of material having a first melt temperature and an outer sheath 40 of a material having a second melt temperature, wherein the first melt temperature is higher than the second melt temperature. In each of the aforementioned embodiments, the heat-activateable, pressure activateable or fluid activateable material, upon being exposed to the appropriate heat, pressure or fluid source, causes the activateable warp yarn 20 to become activated and bonded with the neighboring, abutting warp and weft yarns 16, 18. It is to be further understood that, in addition to the embodiments discussed above, it is contemplated that the activateable warp yarn 20 can be formed by coating an otherwise non-activateable yarn with an activateable coating or adhesive, whether the underlying non-activateable yarn material is a monofilament or multifilament.

Accordingly, a sleeve 10, 10' constructed in accordance with the invention, upon being woven, with the activateable warp yarns 20 having been activated and bonded with the neighboring abutting warp and weft yarns 16, 18, can be readily cold cut with minimal or no end fray resulting, thereby maximizing the useful life of the sleeve 10, 10' while also providing the sleeve 10, 10' with an aesthetically pleasing appearance.

Obviously, many modifications and variations of the present invention are possible in light of the above teachings. It is, therefore, to be understood that within the scope of the appended claims and any ultimately allowed claims, the invention may be practiced other than as specifically described and shown.

What is claimed is:

1. An end fray resistant textile sleeve for protecting elongate members, comprising:

an elongate wall having warp yarns woven with weft yarns, said warp yarns extending lengthwise in generally parallel relation to a longitudinal central axis between opposite ends and said weft yarns extending generally transversely to said warp yarns, said warp yarns including at least two different types of warp yarns, with one type of said warp yarns including a plurality of activateable warp yarns coated with an activateable adhesive material and another type of said warp yarns including a plurality of non-activateable warp yarns, said activateable warp yarns being activateable by at least one of heat, fluid and/or pressure, wherein upon said activateable warp yarns being activated to form activated warp yarns, said activated warp yarns become bonded with adjacent ones of said non-activateable warp yarns and with said weft yarns, at least some of said activated warp yarns being spaced circumferentially from one another by at least some of said non-activateable warp yarns, wherein said activated warp yarns include multifilaments of non-activateable material coated with the activated coating of adhesive material.

2. The end fray resistant textile sleeve of claim 1 wherein said warp yarns and said weft yarns are woven in one of a plain, rib, basket or twill weave pattern.

3. The end fray resistant textile sleeve of claim 1 wherein said weft yarns include multifilaments.

4. The end fray resistant textile sleeve of claim 1 wherein said activateable warp yarns are activated to form activated warp yarns, wherein said activated warp yarns are arranged in a plurality of bundles, each of said bundles including a plurality of activated warp yarns arranged in side-by-side abutting relation with one another, each of said bundles being spaced circumferentially from one another by a plurality of said non-activateable warp yarns.

5. The end fray resistant textile sleeve of claim 4 wherein abutting ones of said activated warp yarns of said bundles undulate over and under said weft yarns out of phase with one another.

6. The end fray resistant textile sleeve of claim 1 wherein said elongate wall is a wrappable wall having opposite edges extending generally parallel to said longitudinal central axis.

7. The end fray resistant textile sleeve of claim 6 wherein said weft yarns include heat-set yarns, said heat-set yarns biasing said opposite edges into overlapping relation with one another.

8. The end fray resistant textile sleeve of claim 6 wherein at least some of said activated warp yarns extend along said opposite edges.

9. The end fray resistant textile sleeve of claim 8 wherein said activated warp yarns extending along said opposite edges are spaced from one another entirely by said non-activateable warp yarns.

* * * * *